United States Patent [19]

Spector et al.

[11] 4,263,971

[45] Apr. 28, 1981

[54] FIRE AND EXPLOSION SUPPRESSION APPARATUS

[76] Inventors: Dov Spector, 36 Har-Dafna St., Savion; Yechiel Spector, 5 Avner St., Zahala-Tel-Aviv, both of Israel

[21] Appl. No.: 902,610

[22] Filed: May 3, 1978

[30] Foreign Application Priority Data

Feb. 27, 1978 [IL] Israel ..... 54139

[51] Int. Cl.[3] ..... A62C 35/12

[52] U.S. Cl. ..... 169/61; 137/87; 169/28; 169/9; 169/62; 340/508

[58] Field of Search ..... 169/7–9, 169/11, 13, 16–18, 23, 28, 57, 60, 61, 62, 75, 5; 340/578, 600, 507, 508, 611, 614, 626, 636; 250/338, 339, 341, 342, 372; 239/498, 515, 518; 98/1.5; 222/61, 135; 137/87, 113

[56] References Cited

U.S. PATENT DOCUMENTS

| | | | |
|---|---|---|---|
| 1,674,480 | 6/1928 | Nelson | 239/498 |
| 2,495,208 | 1/1950 | Causer | 239/498 |
| 2,563,837 | 8/1951 | Grant, Jr. | 169/16 |
| 3,513,311 | 5/1970 | McAlister et al. | 250/372 |
| 3,665,440 | 5/1972 | McMenamin | 250/338 X |
| 3,716,717 | 2/1973 | Scheidweiler | 340/578 X |
| 3,762,479 | 10/1973 | Fike, Sr. et al. | 169/28 |
| 3,865,192 | 2/1975 | Dunphy | 169/62 X |
| 3,925,772 | 12/1975 | Miller et al. | 340/636 |
| 4,005,254 | 2/1977 | Linden et al. | 340/578 X |
| 4,138,670 | 2/1979 | Schneider et al. | 340/507 |
| 4,143,793 | 3/1979 | McMillin et al. | 222/61 X |

FOREIGN PATENT DOCUMENTS

| | | | |
|---|---|---|---|
| 323008 | 7/1902 | France | 239/518 |

*Primary Examiner*—Robert J. Spar
*Assistant Examiner*—Fred A. Silverberg
*Attorney, Agent, or Firm*—Ladas & Parry

[57] ABSTRACT

Suppression apparatus comprises a plurality of pressurized containers of fire extinguishing material arranged in the troop and/or engine compartment of an armored vehicle, the containers having pressure sensors which provide output indications of their operability and their discharge. In rapid response to an alarm indication and to the output indications, logic circuitry initially selects at least one container indicated to be operable, actuates this container to discharge its extinguishing material and, in the absence of an ouput indication of its discharge, actuates an additional container for discharge of extinguishing material therefrom.

16 Claims, 11 Drawing Figures

FIRE AND EXPLOSION SUPPRESSION APPARATUS

BACKGROUND OF THE INVENTION

The present invention relates to fire and explosion prevention systems.

Many systems are known on the market and have been proposed for fighting fires. Such systems employ thermal, light, heat or pressure detectors to determine the existence of a fire or explosion and to actuate fire extinguishing units and are known to be effective for suppressing fires of various origins.

There is no system presently on the market capable of effectively suppressing incipient explosions from both high energy and low energy ignitions. In order to effectively suppress an explosion such as that arising when a HEAT (High Energy Anti Tank) round strikes an armored vehicle, it is necessary to achieve suppression within approximately 100 msecs. following the onset thereof. If suppression can be achieved in this time frame, skin burns to exposed personnel can be limited to first degree and the pressure buildup can be limited to one atmosphere.

SUMMARY OF THE INVENTION

UV/IR detectors suitable for use in explosion suppression systems are described in our copending U.S. Patent Application Ser. No. 902,609 filed concurrently herewith and of common assignment herewith.

The present invention seeks to provide suppression apparatus operative in the required time frame to prevent serious burns to exposed personnel and to limit the pressure buildup to an innocuous level. There is thus provided in accordance with an embodiment of the invention suppression apparatus comprising:

a plurality of containers of extinguishing material disposed for communication with a protected volume;

means for sensing the operational state of the plurality of containers and for providing output indications of the operability and discharge thereof;

actuation circuitry responsive to an alarm indication and to said output indications for initially selecting at least one container indicated to be operable and actuating said at least one container to discharge said extinguishing material in response to said alarm indication and to actuate an additional container in the absence of an output indication of discharge of one of said at least one container.

Further in accordance with an embodiment of the invention, the sensing means is operative for sensing discharge of the container within 10 msec of the discharge thereof and the actuation circuitry operates an additional cylinder within 30 msecs. following a failure to discharge.

In accordance with an embodiment of the invention there is provided a high-speed discharge container containing an extinguishing agent and a pressurizing gas and wherein the following parameters U—the outlet speed of the extinguishing agent in a liquid state (ft/sec)

g—the gravitational acceleration (ft/sec$^2$)

$r_{fl}$—the density of the extinguishing agent in a liquid state (lbs/ft$^3$)

$P_n$—the partial pressure of the pressurizing gas in the container (lbs/ft$^2$)

$v_{no}$—the specific volume of the pressurizing gas in the container (ft$^3$/lbs)

a—the effective outlet opening area (ft$^2$)

$m_n$—the weight of the pressurizing gas in the container (lbs)

$k_n$—the polytropic constant of the pressurizing gas (unitless)

$P_f$—the partial pressure of the extinguishing agent vapor (lbs/ft$^2$)

$v_{fo}$—the specific volume of extinguishing agent vapor in the container (ft$^3$/lbs)

$m_f$—the weight of the extinguishing agent in the gaseous phase in the container (lbs)

$K_f$—the polytropic constant of the extinguishing agent (unitless)

$P_a$—atmospheric pressure (lbs/ft$^2$)

are interrelated by the following approximate expression:

$$U = \left\{ \frac{2g}{r_{fl}} \left[ P_n \left( \frac{v_{no}}{v_{no} + \frac{a}{m_n} \int U\,dt} \right)^{k_n} + P_f \left( \frac{v_{fo}}{v_{fo} + \frac{a}{m_f} \int U\,dt} \right)^{k_f} - P_a \right] \right\}^{\frac{1}{2}}$$

where U is selected to be sufficiently large to produce release of sufficient extinguishing agent within 150 msecs. of actuation.

Further in accordance with an embodiment of the invention there is provided a rapid flow release valve for a container defining a flow path past a container opening and comprising:

a rupture disc disposed across the container opening and blocking said flow path;

high speed pressure generating means disposed outside of said flow path and in pressure communication with said rupture disc, such that actuation of said high speed pressure generating means provides pressure which causes rupture of said rupture disc.

Additionally in accordance with an embodiment of the invention there is provided a dual function pressure monitor for a container defining a fluid flow path comprising:

a pressure sensor disposed outside said fluid flow path and in pressure communication therewith via a venturi channel.

Still further in accordance with an embodiment of the invention there is provided deflector means for directing a high speed fluid flow and comprising a plurality of generally planar elements joined to each other at their respective edges or drawn from one piece to define a common apex and arranged about an axis passing through said apex which is directed parallel to and facing the direction of said flow.

BRIEF DESCRIPTION OF THE DRAWINGS

The invention will be more fully understood and appreciated from the following detailed description taken in conjunction with the drawings in which:

FIG. 5B is a view taken along the section lines B—B of FIG. 5D; FIG. 5A is a view looking in the direction of lines A—A of FIG. 5D;

FIG. 6A is a view taken along the section lines A—A of FIG. 6B.

DESCRIPTION OF THE PREFERRED EMBODIMENT

Figure 1:
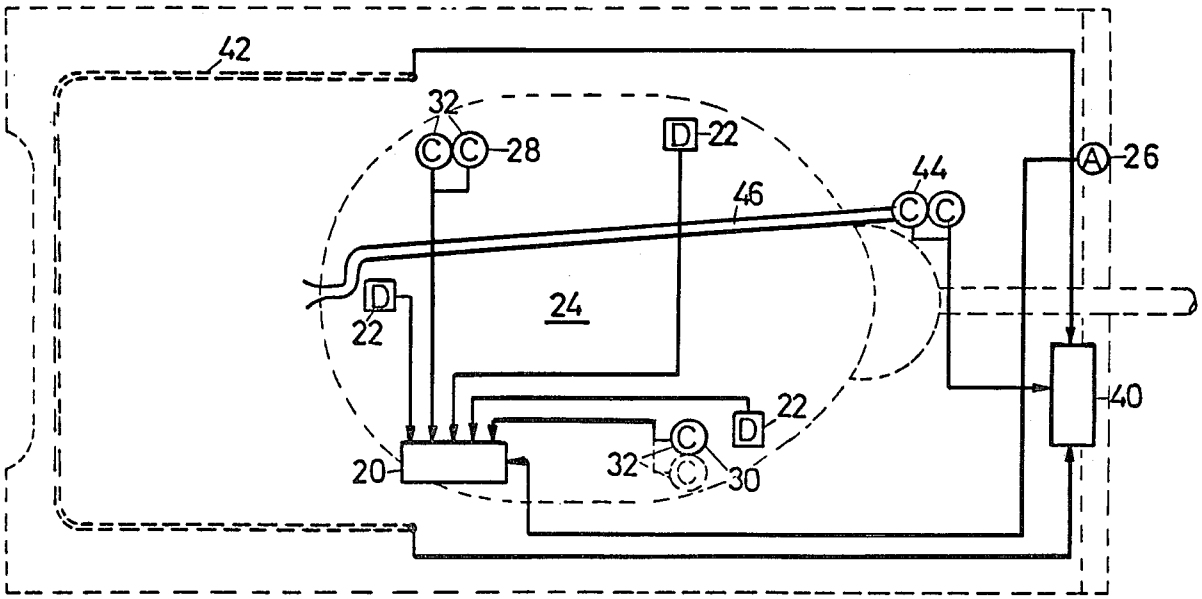
FIG. 1 is a schematic illustration showing the placement of extinguishing material containers and associated equipment in a typical armored vehicle in accordance with an embodiment of the invention.

Reference is now made to FIG. 1 which illustrates in schematic form the placement of fire and explosion detection and suppression apparatus in a typical armored vehicle. The apparatus is divided into two operational sub-systems, System I for the protection of the Troop Compartment and System II for the protection of the Engine Compartment. The operation of the individual sub-systems will be described hereinafter in connection with FIG. 2.

System I comprises control circuitry 20 which receives alarm inputs from three detector assemblies 22 distributed in the Troop Compartment 24, which is indicated in oval outline. An example of a detector assembly useful in the embodiment of the invention is the UV/IR detector described in our aforementioned copending U.S. Patent Application Ser. No. 902,609 filed concurrently herewith. Control circuitry 20 also receives an input signal from a manually actuable trigger switch 26 located at the outside of the vehicle.

Control circuitry 20 is electrically coupled to a pair of extinguishing agent distribution assemblies 28 and 30. Assembly 28 typically comprises two extinguishing agent containers 32 while assembly 30 may comprise either one or two such containers. Containers 32 and the apparatus associated therewith will be described hereinafter in detail in connection with FIGS. 3–5. The placement and orientation of the containers is determined empirically for each configuration of vehicle or other volume to be protected in order to provide speedy and uniform distribution of the extinguishing agent upon actuation of the system. For the purposes of the discussion which follows, it will be understood that each of containers 32 is equipped with a discharge valve and a pressure sensor. The pressure sensor provides a continuous indication of the operability of the cylinder, in the sense of it being fully pressurized, and an immediate indication of the discharge thereof.

System II, for protection of the Engine Compartment, located, in the illustrated embodiment, at the rear of the armored vehicle, comprises control circuitry 40 which is activated by a wire type heat detector 42 which extends along the periphery of the engine compartment. Heat detector 42 may be, for example, a model WK 716287 manufactured by Walter Kidde of the U.S.A. The control circuitry 40 may also be actuated by a manually actuable trigger switch, such as switch 26.

Control circuitry 40 serves to actuate an extinguishing agent distribution assembly 44 which is located at the front of the vehicle and in fluid communication, via a suitable conduit 46 with the engine compartment at the rear thereof.

Systems I and II are supplied with electrical power through suitable main and backup power systems and are designed to function even when the vehicle is otherwise disabled.

The control circuitry 20 indicated schematically in FIG. 1 is operative in two alternative modes, a normal mode where the likelihood of hostile fire is negligible, and a combat mode, wherein hostile fire is possible. The precise operation of the control circuitry, which comprises conventional logic circuitry components will now be completely described with reference to the flow charts provided in FIGS. 2A and 2B. These charts refer to an installation having four containers 32.

In normal mode operation (FIG. 2A) using three detector assemblies, four alternative possibilities are considered. If only one detector assembly is activated there is no response.

If two detector assemblies are activated within a time span of more than 10 msecs., and cylinder #1 is operable, cylinder #1 is actuated. Once discharge is completed, the system is ready for normal operation after five seconds. If cylinder #1 fails to discharge and cylinder #2 is operable, cylinder #2 is actuated. Once discharge is completed the system is ready for normal operation after five seconds.

If cylinder #2 fails to discharge when actuated or if both cylinders #1 and #2 are inoperable, cylinder #3 is actuated if operable. Once discharge is completed the system is ready for normal operation after five seconds. If cylinder #3 is inoperable or fails to discharge when actuated, cylinder #4 is actuated if operable.

In the event that two detector assemblies are activated within a time span of less than 10 msecs. or if all three detector assemblies are activated, cylinders #1 and #3 are both activated if operable. If cylinder #1 is inoperable or fails to discharge when actuated, cylinder #2 is actuated if operable. If cylinders #2 or #3 are inoperable or fail to discharge when actuated, cylinder #4 is actuated if operable. If cylinders #3 and #4 are inoperable or fail to discharge when actuated and cylinder #1 operates properly, cylinder #2 is actuated if operable. Once two cylinders discharge, the system is ready for normal operation after five seconds, to the extent that operable cylinders remain.

The system operates in the Combat Mode (FIG. 2B) in response to a manually entered indication. During operation in the Combat Mode, the system operation is the same irrespective of the number of detector assemblies which are activated at the same time. Thus in response to detection by one or more detector assemblies, the control circuitry actuates cylinders #1 and #3 if operable. If cylinder #1 is inoperable, cylinders #2 and #3 are actuated if operable. Similarly if cylinder #3 is inoperable, cylinders #1 and #4 are actuated if operable.

If cylinder #1 fails to discharge when actuated, cylinder #2 is actuated if operable. If cylinder #2 is either inoperable or fails to discharge when actuated, cylinder #4 is actuated if operable. Similarly if cylinder #3 fails to discharge when actuated, cylinder #4 is actuated if operable. If cylinder #4 is either inoperable or fails to discharge when actuated, cylinder #2 is actuated if operable.

If both cylinders #1 and #3 fail to discharge when actuated, then cylinders #2 and #4 are actuated if operable.

Once two cylinders discharge properly, the system is once again ready for operation after five seconds to the extent that operable cylinders remain.

It is a particular feature of the invention, that the operations described above take place in very short periods of time, in the order of milliseconds, to substitute operable containers for inoperable or inoperative containers in sufficient time to suppress an explosion.

Figure 2A:
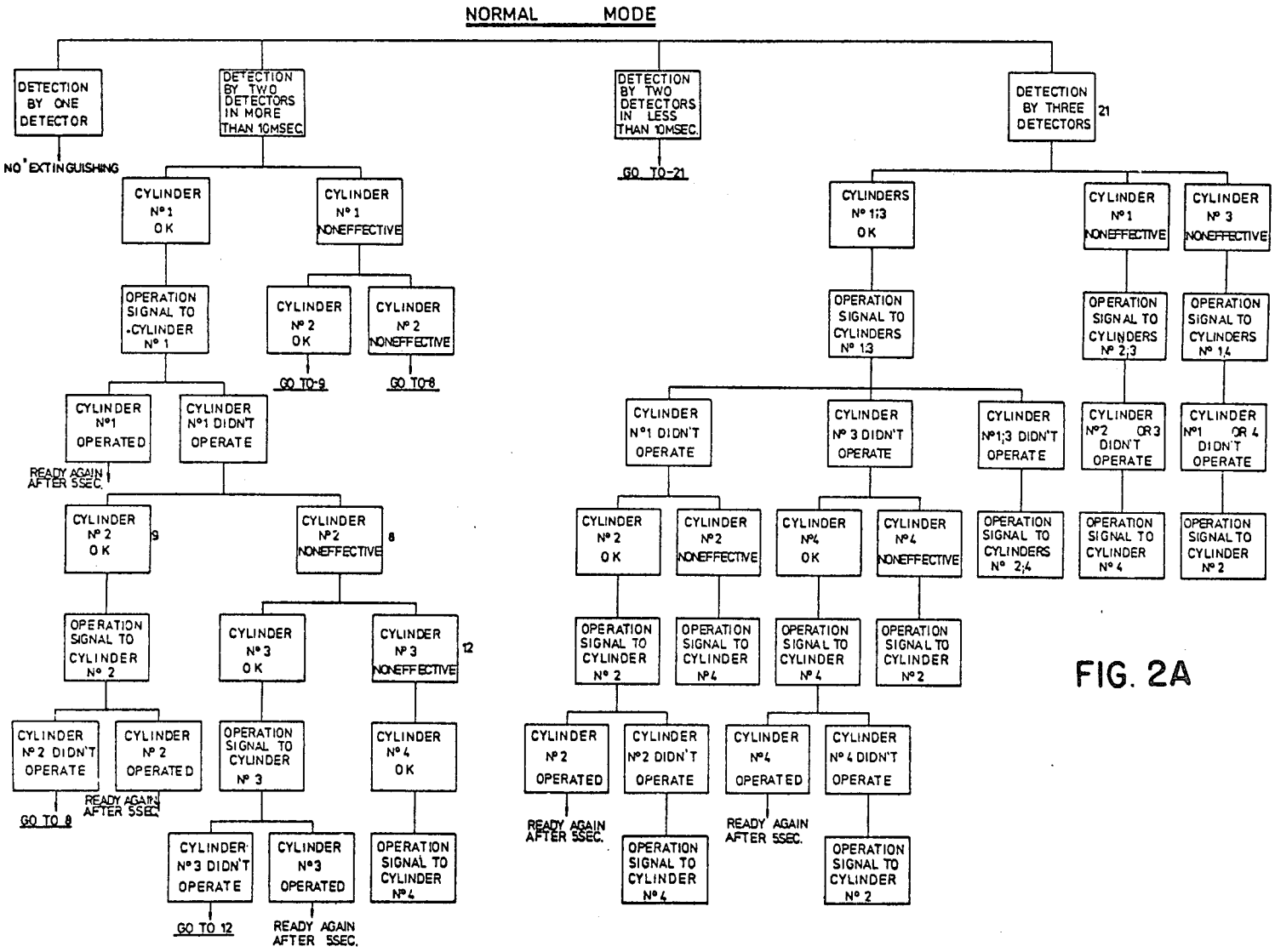
FIGS. 2A and 2B are flow charts respectively illustrating normal and combat modes of the logical operation of actuation circuitry constructed and operative in accordance with an embodiment of the invention.
Figure 2B:
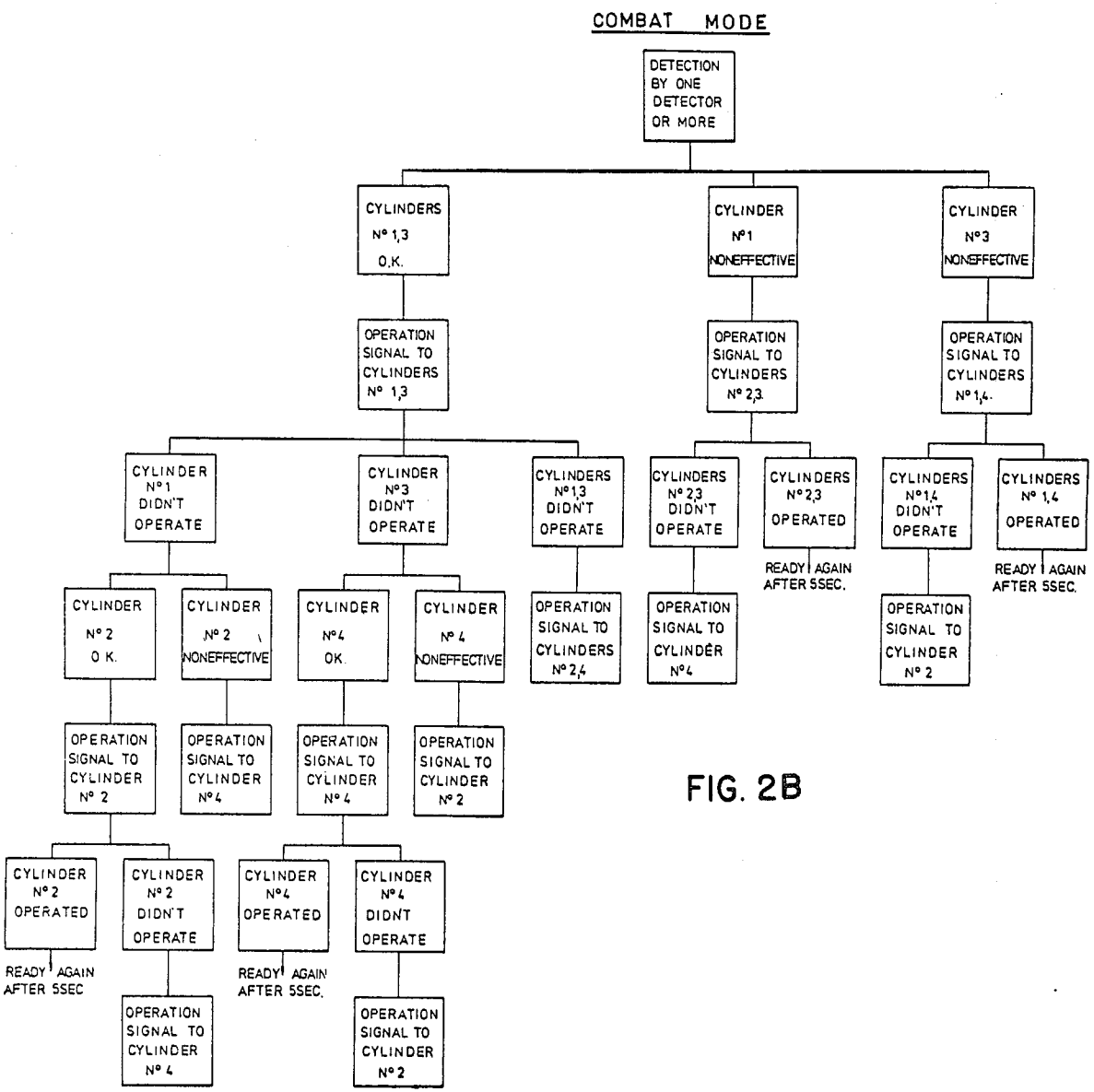

The operations of control circuitry 20 indicated in the flow charts of FIGS. 2A and 2B are preferably implemented by the exemplary layout of conventional logic circuitry components depicted in the block diagram of FIG. 3 which will now be described.

Figure 3:
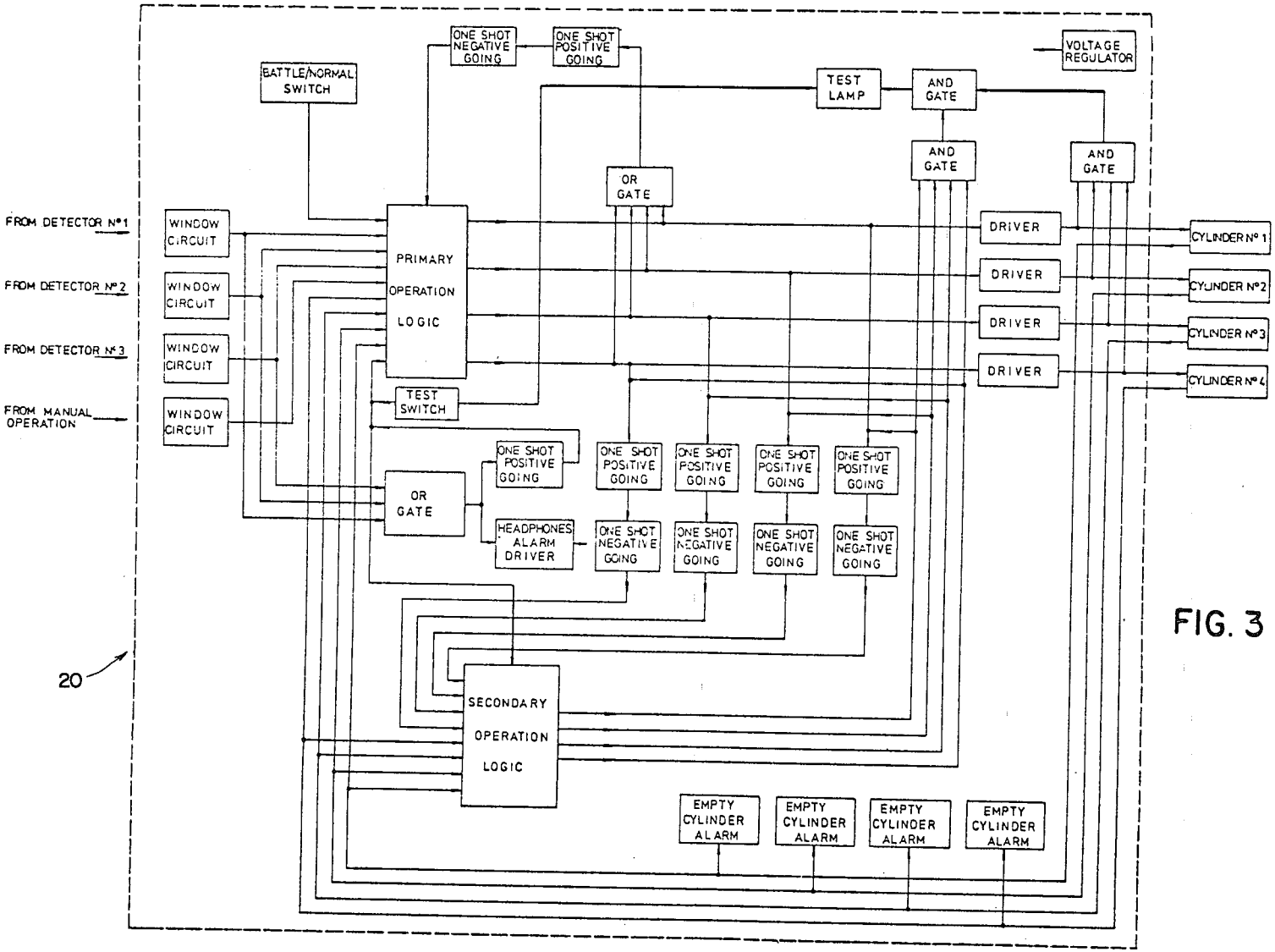
FIG. 3 is a block diagram of the actuation circuitry whose logical operation is illustrated in FIGS. 2A and 2B.

In FIG. 3, the alarm inputs from DETECTOR NOS. 1, 2 and 3, corresponding to the three detector assemblies 22 of FIG. 1, are received by respective Window Circuits of control circuitry 20, and the output of each Window Circuit is simultaneously fed to a respective input of a PRIMARY OPERATION LOGIC chip (PROM 512×4) and to a respective input of a first OR GATE. CYLINDER NOS. 1, 2, 3 and 4, corresponding to the four containers 32 within troop compartment 24 (FIG. 1), receive their actuating signals by way of respective DRIVER circuits from respective output leads of PRIMARY OPERATION LOGIC under control of other inputs to PRIMARY OPERATION LOGIC. One such other input is the output of a monostable multivibrator (ONE SHOT POSITIVE GOING) triggered by the first OR GATE, another input is the output of the mode selector BATTLE/NORMAL SWITCH and four other inputs each indicative of an empty cylinder and used to energize a respective EMPTY CYLINDER ALARM are received from CYLINDER NOS. 1, 2, 3 and 4. A "chip enable" input is additionally received by PRIMARY OPERATION LOGIC by way of two series-connected monostable multivibrators (ONE SHOT POSITIVE GOING and ONE SHOT NEGATIVE GOING) from a second OR GATE having an input from each of the outputs of PRIMARY OPERATION LOGIC.

The empty cylinder indicating inputs to PRIMARY OPERATION LOGIC are also applied as inputs to a SECONDARY OPERATION LOGIC chip (PROM 256×4) which receives four additional inputs, each by way of two series-connected monostable multivibrators (ONE SHOT POSITIVE GOING and ONE SHOT NEGATIVE GOING) triggerable by the respective outputs of PRIMARY OPERATION LOGIC and by the respective outputs of SECONDARY OPERATION LOGIC, whichever arrives first. A "chip enable" input is moreover received from the monostable multivibrator triggered by the first OR GATE.

For testing the operation of control circuitry 20, a TEST SWITCH and TEST LAMP are provided. Closing of the TEST SWITCH applies inputs to PRIMARY OPERATION LOGIC and SECONDARY OPERATION LOGIC simulating the inputs thereto from the monostable multivibrator triggered by the first OR GATE. At the same time, the TEST SWITCH applies one of two inputs to the TEST LAMP. The other input to the TEST LAMP is received from a first AND GATE when the latter concurrently receives respective inputs from a second AND GATE and a third AND GATE. The second AND GATE responds to the respective outputs of SECONDARY OPERATION LOGIC, while the third AND GATE responds to the respective outputs of the cylinder DRIVER circuits. All necessary supply voltages for control circuitry 20 are provided by a VOLTAGE REGULATOR shown in FIG. 3 without its connections in order to simplify the block diagram.

Figure 4:
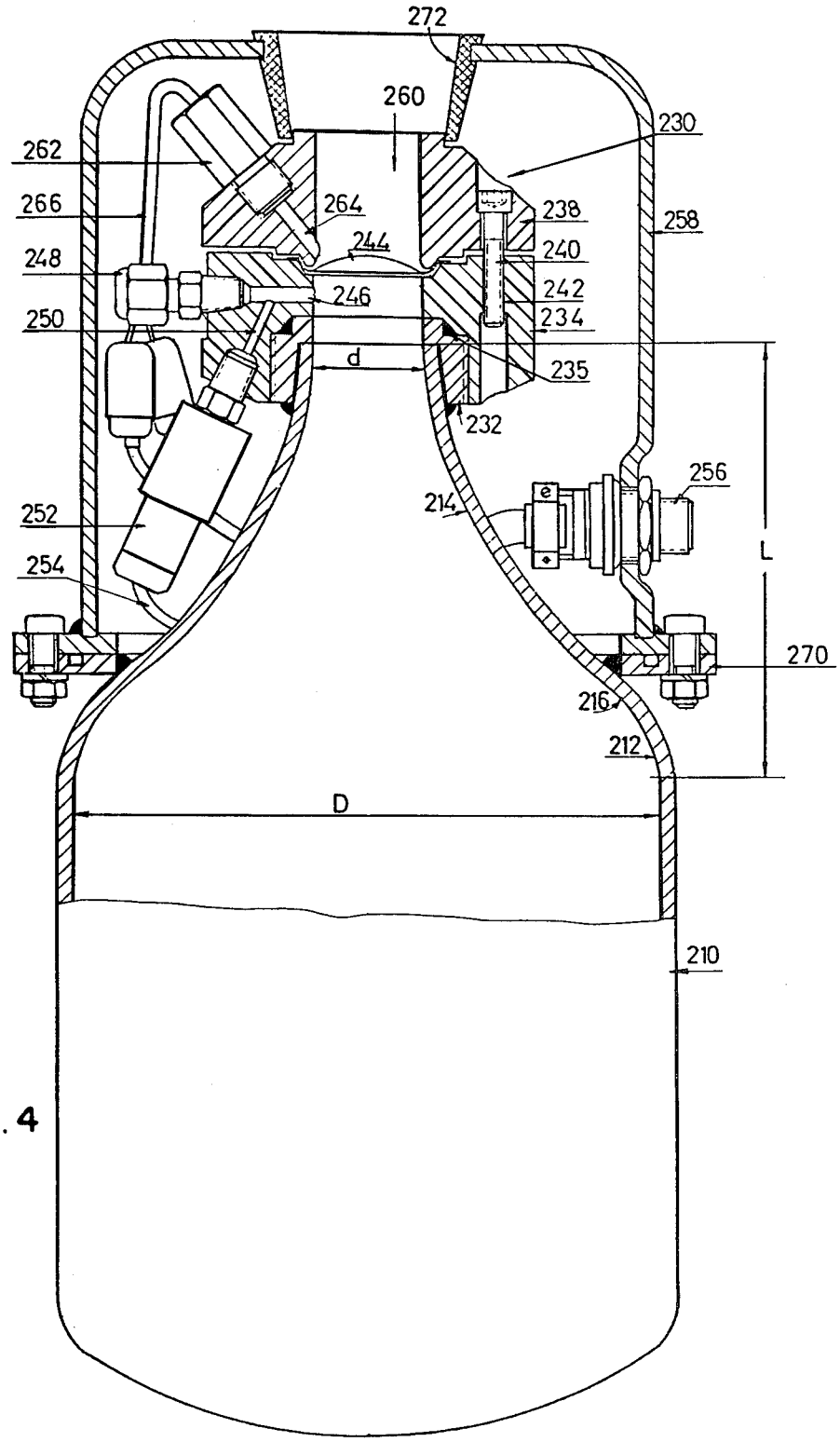
FIG. 4 is an illustration of one embodiment of an extinguishing material container, release valve assembly and pressure monitor constructed and operative in accordance with an embodiment of the invention.
Figure 5B:
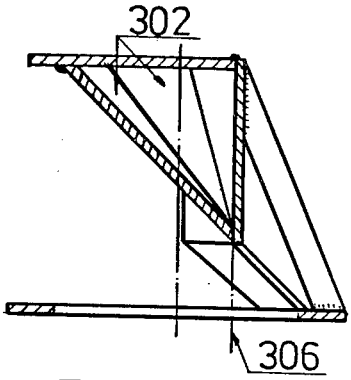
FIGS. 5A, 5B, 5C, and 5D are illustrations of one embodiment of a deflector constructed and operative in accordance with an embodiment of the invention.
Figure 5A:
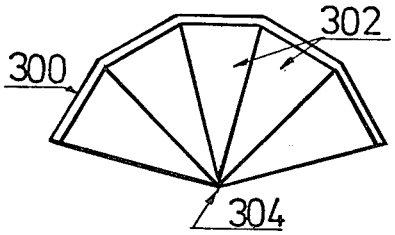
Figure 5C:
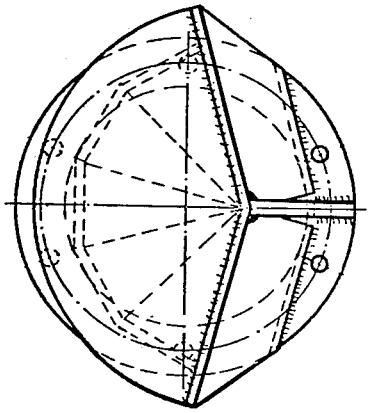
Figure 5D:
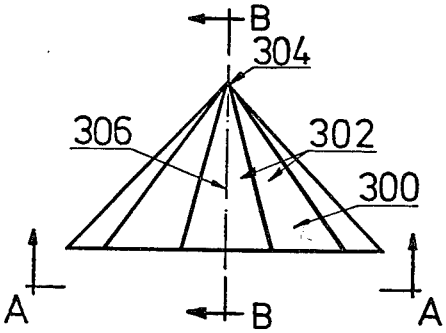

Reference is now made to FIG. 4, which illustrates one embodiment of an extinguishing material container, release valve assembly and pressure monitor constructed and operative in accordance with an embodiment of the invention. It is a particular feature of the invention that the container can empty its contents within 150 milliseconds of receipt of an actuation signal.

The container 210 is of a special construction designed to provide extremely fast emptying thereof. The design parameters of the container and the filling and pressurization thereof will now be described:

On the basis of a calculation of the total volume of a compartment, such as the troop compartment of an armored vehicle, to be protected and the total number and placement of the extinguishing agent containers therein as well as the desired concentration of extinguishing agent in this volume to achieve suppression, typically five percent, a determination of the amount of extinguishing agent to be contained in each container is arrived at.

In practice, the container is filled with an extinguishing agent such as Halon 1301, manufactured by Du Pont of the U.S.A. The extinguishing agent is stored in a liquid state under pressure and fills a portion of the containers. A pressurizing gas, such as nitrogen is also contained in the container.

The interrelationship between various parameters which govern the speed at which the extinguishing agent leaves the container outlet is determined by the following approximate expression:

$$U = \left\{ \frac{2g}{r_{fl}} \left[ P_n \left( \frac{v_{no}}{v_{no} + \frac{a}{m_n} \int U\,dt} \right)^{k_n} + P_f \left( \frac{v_{fo}}{v_{fo} + \frac{a}{m_f} \int U\,dt} \right)^{k_f} - P_a \right] \right\}^{\frac{1}{2}}$$

where:

U—the outlet speed of the extinguishing agent in a liquid state (ft/sec)

g—the gravitational acceleration (ft/sec$^2$)

$r_{fl}$—the density of the extinguishing agent in a liquid state (lbs/ft$^3$)

$P_n$—the partial pressure of the pressurizing gas in the container (lbs/ft$^2$)

$v_{no}$—the specific volume of the pressurizing gas in the container (ft$^3$/lbs)

a—the effective outlet opening are (ft$^2$)

$m_n$—the weight of the pressurizing gas in the container (lbs)

$k_n$—the polytropic constant of the pressurizing gas (unitless)

$P_f$—the partial pressure of the extinguishing agent vapor (lbs/ft$^2$)

$v_{fo}$—the specific volume of extinguishing agent vapor in the container (ft$^3$/lbs)

$m_f$—the weight of the extinguishing agent in the gaseous phase in the container (lbs)

$K_f$—the polytropic constant of the extinguishing agent (unitless)

$P_a$—atmospheric pressure (lbs/ft$^2$)

The above expression is solved by conventional computer techniques using a trial and error and iteration program. In the program the following parameters are varied: total container volume, the pressure in the container when pressurized, total weight of extinguishing agent, effective outlet opening area and ambient temperature in the operating environment.

The computer program provides for a given emptying time and volume of extinguishing agent, a plurality of combination of the various parameters from which a useful combination thereof may be selected, on the basis of which the container may be constructed. The value for U, the outlet speed of the extinguishing agent is selected to be sufficiently large to produce the desired concentration of extinguishing agent in the volume within 150 msecs. of actuation.

Once a given combination of parameters has been selected, the amount of extinguishing agent and of nitrogen and thus the container volume and the outlet opening area are known for a given operating environment temperature.

The container dimensions and inner configuration is then determined on the basis that the ratio between the outlet diameter d and the body diameter D should be in the range of 1:5 to 1:10. Limits to these dimensions are determined by installation requirements. The shape of the narrowing portion of the container connecting the body portion of the container to the outlet thereof is determined in accordance with the teachings of Rouss-Hassen set forth at pages 580–581 of the *Engineering Handbook* by S. G. Ettingen, Volume I, 1954 (Hebrew) which determines the relationship between the length of the narrowing portion L which is defined in cross section by two intersecting parabolas 212 and 214 and the body diameter D as well as the relationship between L and the point of intersection 216 of the two parabolas 212 and 214.

In the exemplary embodiment built and tested by applicants the body diameter D is 150 mm, the outlet diameter d is 26 mm and the length L of the narrowing portion is 110 mm. The point of intersection of the parabolas is 90 mm along L from the outlet. The overall length of the container is 275 mm.

The container is made of high strength metal by molding or deep drawing techniques suitable for high pressure applications and is formed with a smooth inner surface to reduce friction.

Coupled to the outlet end of container 210 is a pressure monitor and release valve assembly 230. Assembly 230 comprises a mounting collar 232 which is sealingly attached onto the container adjacent the outlet. A pressure monitor mounting assembly 234 is threadably mounted onto collar 232 and sealed thereonto by an O-ring 235. A second monitoring assembly 238 cooperates with mounting assembly 234 and is secured thereonto by means of a threaded screw 240 which engages a threaded socket 242.

Collar 232 and mounting assemblies 234 and 238 all define an exit flowpath 260 for extinguishing agent from the container which extends from the outlet thereof, in a generally coaxial orientation. The flowpath is sealed by a rupture disc 244 mounted between cooperative mounting assemblies 234 and 238.

Formed in mounting assembly 234 is a radially extending filling channel 246, which is sealed by a plug assembly 248. Communicating with channel 246 is a secondary channel 250 which leads to a pressure sensor 252. Pressure sensor 252 may be any suitable pressure sensor having a high speed response. In practice, we use Model P 776-F-3505-T-X manufactured by WHITMAN-GENERAL and obtain a high speed response therewith for sensing discharged due to a Venturi suction effect. Pressure sensor 252 provides an output signal via an electrical cable 254 which is connected to a connector plug 256 which is mounted onto a sealed cover member 258 which covers the outlet end of the container.

Pressure sensor 252 performs a dual function, indicating the steady state pressure of the filled container and thus monitoring its operability, and also providing an immediate indication of discharge of the container by sensing the negative pressure produced in channels 246 and 250 by a flow of liquid extinguishing agent through the flowpath 260 by means of the Venturi suction effect.

A high speed pressure generator, typically a detonator 262 is mounted onto mounting assembly 238 and communicates with flowpath 260 only via an inclined channel 264 formed in assembly 238 and arranged to face rupture disc 244. Detonator 262 is operated by an electrical signal transmitted via a cable 266, communicating with connector 256, to produce an immediate burst of pressure which passes through channel 264 and impinges directly on rupture disc 244, causing its rupture and permitting immediate and substantially unimpeded release of the pressurized extinguishing agent in the container.

It is a particular feature of the present invention that the pressure generator is disposed entirely outside of flowpath 260 and communicates only via a pressure channel therewith, so as not to interfere with the outflow of the extinguishing agent. Since the pressure sensor is similarly mounted outside of the flowpath, the extinguishing agent is afforded a substantially unobstructed flowpath once the rupture disc is broken.

Sealable cover 258 is secured onto a mounting collar 270 which may be welded or otherwise joined in the container 210. Cover 258 defines a short nozzle 272 which is aligned coaxially with flowpath 260 and is wider than the flowpath so as not to substantially interfere with the flow therepast.

It is a particular feature of the invention that the pressure sensor is operative to sense discharge of a cylinder within 10 msecs. of the discharge thereof and the actuation circuitry, such as control circuitry 20 operates an additional cylinder within 30 msecs. following a failure to discharge.

Reference is now made to FIGS. 5A–5D which shows one embodiment of a deflector which may be used in association with the extinguishing material container illustrated exemplarily in FIG. 4. The deflector may comprise a generally pyramidal structure 300 formed of a plurality of triangular planar portions 302 joined together at their respective side edges to define a common apex 304. The apex is normally arranged along a central axis 306 which is oriented parallel to the axis of the fluid flow along flowpath 260 (FIG. 4). The deflector may be symmetric about axis 306 and have a 360° exposure or it may have only a 150° C. exposure for example, depending on the desired application and the direction in which it is desired to deflect the extinguishing agent.

The deflector is normally mounted in a desired orientation onto the extinguishing agent container and is operative in accordance with a preferred embodiment of the invention to direct the flow of extinguishing agent in a desired direction with a minimum of friction and with a minimum of back pressure between the deflector and the container outlet which can impede discharge thereof.

Figure 6A:
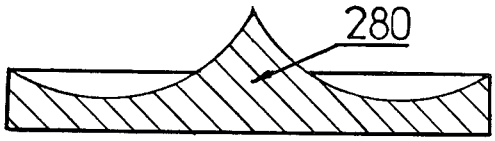
FIGS. 6A and 6B are illustrations of another embodiment of a deflector constructed and operative in accordance with an embodiment of the invention.
Figure 6B:
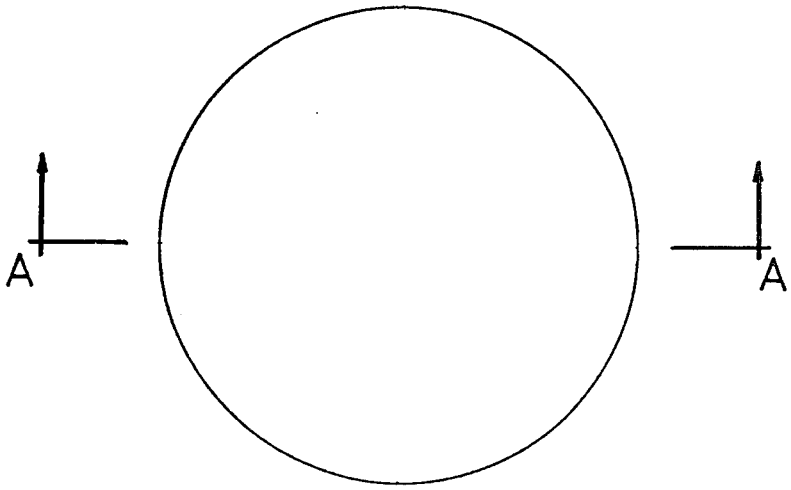

An alternative embodiment of deflector is illustrated in FIGS. 6A and 6B and comprises a symmetric configuration having a central cusp and a minor edge cusp when viewed in cross section. The deflector of FIGS. 6A and 6B is arranged about a central axis 280 which is usually aligned along the axis of flowpath 260 (FIG. 4) and provides a reversal of flow direction coupled with a radial distribution.

It will be appreciated that only exemplary embodiments of the invention have been specifically illustrated and described hereinabove. The invention is not limited to what has been specifically shown and described. Rather, the scope of the invention is defined only by the claims which follow.

We claim:

1. Suppression apparatus comprising:

a plurality of containers of extinguishing material disposed for communication with a protected volume;

means for sensing the operational state of the plurality of containers and for providing output indications of the operability and discharge thereof; and actuation circuitry responsive to an alarm indication and to said output indications for initially selecting at least one container indicated to be operable, actuating said at least one container to discharge said extinguishing material in response to said alarm indication and actuating an additional container in the absence of an output indication of the discharge of one of said at least one containers; and wherein said sensing means is operative for sensing discharge of the container within 10 msecs. of the discharge thereof and the actuation circuitry operates an additional cylinder within 30 msecs. following a failure to discharge.

2. Suppression apparatus according to claim 1 and wherein said containers of extinguishing material also contain a pressurizing gas and are characterized by the following approximate expression:

$$U = \left\{ \frac{2g}{r_{fl}} \left[ P_n \left( \frac{v_{no}}{v_{no} + \frac{a}{m_n} \int U\,dt} \right)^{k_n} + P_f \left( \frac{v_{fo}}{v_{fo} + \frac{a}{m_f} \int U\,dt} \right)^{k_f} - P_a \right] \right\}^{\frac{1}{2}}$$

where

U—the outlet speed of the extinguishing agent in a liquid state (ft/sec)

g—the gravitational acceleration (ft/sec$^2$)

$r_{fl}$—the density of the extinguishing agent in a liquid state (lbs/ft$^3$)

$P_n$—the partial pressure of the pressurizing gas in the container (lbs/ft$^2$)

$v_{no}$—the specific volume of the pressurizing gas in the container (ft$^3$/lbs)

a—the effective outlet opening area (ft$^2$)

$m_n$—the weight of the pressurizing gas in the container (lbs)

$k_n$—the polytropic constant of the pressurizing gas (unitless)

$P_f$—the partial pressure of the extinguishing agent vapor (lbs/ft$^2$)

$V_{fo}$—the specific volume of extinguishing agent vapor in the container (ft$^3$/lbs)

$m_f$—the weight of the extinguishing agent in the gaseous phase in the container (lbs)

$K_f$—the polytropic constant of the extinguishing agent (unitless)

$P_a$—atmospheric pressure (lbs/ft$^2$).

3. Apparatus according to claim 1 and wherein said sensing means comprises a pressure sensor disposed outside of said discharge flow path.

4. Apparatus according to claim 3 and wherein said pressure sensor communicates with said discharge flow path via a Venturi channel.

5. Apparatus according to claim 1 and also comprising deflector means for directing the discharge flow from said container, said deflector means having a plurality of generally planar elements joined to each other at their respective side edges or formed as such from one piece to define a common apex and arranged about an axis passing through said apex which is directed generally parallel to and facing the direction of said discharge flow.

6. Apparatus according to claim 1 and wherein each of said containers defines a substantially straight flow path for discharge of said extinguishing material.

7. Apparatus according to claim 1 and also comprising manually operable actuation means for causing discharge of said containers.

8. Apparatus according to claim 1 and also comprising detector means comprising a plurality of detectors for providing said alarm indication and wherein said actuation circuitry is responsive to the nature of said alarm indication for determining the timing of container actuation.

9. Apparatus according to claim 8 and wherein the time separation between detector outputs, determines the timing of container actuation.

10. Apparatus according to claim 1 and wherein said actuation circuitry is operative to discharge containers in a predetermined sequence.

11. Apparatus according to claim 1 and wherein said actuation circuitry is operative to provide successive extinguishing operations in response to successive alarm indications.

12. Suppression apparatus comprising:

a plurality of containers of extinguishing material disposed for communication with a protected volume;

means for sensing the operational state of the plurality of containers and for providing output indications of the operability and discharge thereof; and actuation circuitry responsive to an alarm indication and to said output indications for initially selecting at least one container indicated to be operable, actuating said at least one container to discharge said extinguishing material in response to said alarm indication and actuating an additional container in the absence of an output indication of the discharge of one of said at least one containers;

and wherein said container defines a discharge flow path past a container opening, said apparatus also comprising:

a rupture disc disposed across the container opening and blocking said flow path;

high speed pressure generating means disposed outside of said flow path and in pressure communication with said rupture disc, such that actuation of said high speed pressure generating means provides pressure which causes rupture of said rupture disc.

13. Apparatus according to claim 12 and wherein said high speed pressure generating means comprises an electrically actuated detonator.

14. Apparatus according to claim 13 and wherein said detonator is coupled to said discharge flow path via a narrow channel oriented to face said rupture disc and such that actuation of said detonator causes pressure to impinge on said rupture disc.

15. A rapid flow release view for a container defining a discharge flow path past a container opening and comprising:

a rupture disc disposed across the container opening and blocking said flow path;

high speed pressure generating means disposed outside of said flow path and in pressure communication with said rupture disc, such that actuation of said high speed pressure generating means provides pressure which causes rupture of said rupture disc.

16. Apparatus according to claim 15 and wherein said flow path is substantially straight.

* * * * *